United States Patent [19]

Lonati

[11] 4,373,360

[45] Feb. 15, 1983

[54] DEVICE FOR CORRECTLY POSITIONING YARNS PRIOR TO KNITTING IN A CIRCULAR KNITTING MACHINE

[75] Inventor: Francesco Lonati, Brescia, Italy

[73] Assignee: Costruzioni Meccaniche Lonati S.p.A., Brescia, Italy

[21] Appl. No.: 189,240

[22] Filed: Sep. 22, 1980

[30] Foreign Application Priority Data

Oct. 1, 1979 [IT] Italy ..... 26156 A/79

[51] Int. Cl.[3] ..... D04B 15/48; D04B 15/60

[52] U.S. Cl. ..... 66/131; 66/140 R

[58] Field of Search ..... 66/125 R, 134, 138, 66/139, 140 R, 140 S, 232, 234, 131

[56] References Cited

U.S. PATENT DOCUMENTS

| | | | |
|---|---|---|---|
| 966,707 | 8/1910 | Rogginger | 66/131 X |
| 2,919,566 | 1/1960 | Felker | 66/140 S |
| 3,077,097 | 2/1963 | Butler | 66/140 S |
| 3,813,900 | 6/1974 | Cook et al. | 66/125 R |
| 4,137,732 | 2/1979 | Gostelow et al. | 66/140 R |
| 4,233,826 | 11/1980 | Lonati | 66/140 R |

FOREIGN PATENT DOCUMENTS

| | | | |
|---|---|---|---|
| 1963468 | 6/1971 | Fed. Rep. of Germany | 66/134 |
| 2844903 | 4/1979 | Fed. Rep. of Germany | 66/139 |
| 426253 | 4/1911 | France | 66/131 |
| 926857 | 5/1963 | United Kingdom | 66/125 R |
| 2016530 | 9/1979 | United Kingdom | 66/140 R |

*Primary Examiner*—Wm. Carter Reynolds

*Attorney, Agent, or Firm*—Guido Modiano; Albert Josif

[57] ABSTRACT

To blow a yarn toward the needles and release it from the gripping device upon yarn feeding in a circular knitting machine, in particular a double cylinder one, a device is provided which is synchronized with each yarn feeding finger regardless of the number of feeds. The device comprises a control cam provided with a boss and rotated synchronically with the needle cylinder(s), an actuating cam provided with two oppositely located notches and connected to the control cam through a normally disengaged coupling controlled by the machine program, and an actuating lever which follows the profile of the actuating cam and controls a valve to cause it to engage with the control cam and be operated by the boss thereof to deliver pressurized air to the yarn feeding area. The valve can be moved into the operative position by means of each yarn feeding finger associated with one feed.

11 Claims, 6 Drawing Figures

DEVICE FOR CORRECTLY POSITIONING YARNS PRIOR TO KNITTING IN A CIRCULAR KNITTING MACHINE

BACKGROUND OF THE INVENTION

This invention relates to a device for correctly positioning the yarns prior to knitting in a circular knitting machine, in particular a hose knitting machine.

More specifically, reference will be made hereinafter to a double cylinder circular hose knitting machine, without the invention being limited to just that application.

It is known that, for correctly positioning a yarn to be knitted in a double cylinder circular knitting machine, a pneumatic device is currently employed which comprises suitably oriented blowing nozzles operative to bring the yarn close to the needles and release the yarn from the gripping device which holds it while it is not being knitted by the needles.

The basic problem is that of ensuring that the yarn is picked up by the needles, which cannot be made quite certain by the mere mechanical approach of the yarn feeding finger to the needle path, and that of ensuring that the yarn is released from the gripping device such that it can run freely as it is being set to knit by the needles.

It is further necessary that the blowing devices cut in timely and synchronically with the actuation of the other members involved, that is the cutting in of the yarn feeding finger and releasing of the gripping device. For this purpose, cams associated with the yarn feeding finger control unit are provided, which cams actuate, through a number of intervening members, valves adapted for admitting pressurized fluid to the blowing nozzles. However, that construction takes up much space, so that its application is limited to but one of the striper units included in the machine, that is to a single feed. For the remaining striper units, i.e. the remaining feeds, the blowing device is put under control by the machine main chain. However, this implies an imperfectly synchronized action with the respective yarn feeding fingers, because the control impulse, as derived from the main chain, can only be applied as the chain is moving forward and must be maintained throughout the time that the chain is held stationary prior to the successive moving step.

It will be appreciated, moreover, that the space requirements of such a system are aggravated by the necessary presence of members for picking up the control impulse from the chain and transferring it to the blowing devices. If a higher number of yarn feeds is used, then a correspondingly higher number of main chain operated controls must also be provided, which controls, among others, would have to cut in at successive times, owing to the feeds being angularly offset about the needle cylinder; but a control impulse derived from the main chain, which is advanced stepwise, would not allow such a cutting-in in succession.

SUMMARY OF THE INVENTION

This invention sets out to provide a device for correctly positioning the yarns prior to knitting in a circular knitting machine, in particular a double cylinder hose knitting machine, which is comparatively compact in size and affords the possibility of having the blowing control perfectly synchronized with the cutting in of the yarn feeding fingers at all of the yarn feeds, regardless of their number.

Within that general aim, it is further possible to arrange that the device according to the invention can be controlled by means of any desired master programmer, and not necessarily through the main drum or main chain of the machine.

According to this invention, there is provided a device for correctly positioning the yarns prior to knitting in a circular knitting machine, in particular a double cylinder hose knitting machine, comprising blowing nozzles respectively oriented toward the needle cylinder(s) and yarn gripping device, respective valves for admitting pressurized fluid from a source of fluid under pressure to said nozzles, and programmed means for controlling said valves, the device being characterized in that said control means comprise at least one control cam associated to a respective striper unit and respective gripping device, said control cam being associated with a respective one of said valves such as to operate said valve simultaneously with the actuation of any one of the yarn feeding fingers of the striper unit associated with said valve.

Advantageously, in accordance with a preferred embodiment of the invention, there is associated with said control cam, through a respective coupling under control by the machine program, one actuating cam for each yarn feeding finger in one striper unit, the rotation of said actuating cam effecting a positive control of said valve by said control cam, when said coupling makes said control cam and actuating cam mechanically interconnected for rotation.

In a device according to the invention, each yarn blowing control impulse is derived, regardless of the number of the feeds, either directly or indirectly from the control of one of the yarn feeding fingers. In other words, as one of the yarn feeding fingers is operated by the machine program, the control cam is caused to act on the valve which is associated with the striper unit comprising that particular feeding finger. It will be appreciated, therefore, that in this manner a single cam only need be provided for each striper unit, thereby the space requirements can be modest, even when the striper units and feeds happen to be two or more in number, while a single control is used for a positive action of the control cam on the associated valve, that control being actuated by any one of the yarn feeding fingers in the respective striper unit. The net result is an operation of the blowing nozzles which is perfectly synchronized with the respective yarn feeding finger, as moved into the operative position by the machine program, and this regardless of the feed number and their arrangement around the needle cylinders. It will be also appreciated that, as the number of the yarn feeds increases, it becomes possible to arrange the cams and valves side-by-side without appreciably increasing the space requirements of the entire control device.

BRIEF DESCRIPTION OF THE DRAWINGS

Further features and advantages of the invention will be more clearly apparent from the following detailed description of a preferred, though not limitative, embodiment of a device according to the invention, as illustrated by way of example only in the accompanying drawings, where.

DESCRIPTION OF THE PREFERRED EMBODIMENTS

Figure 1:
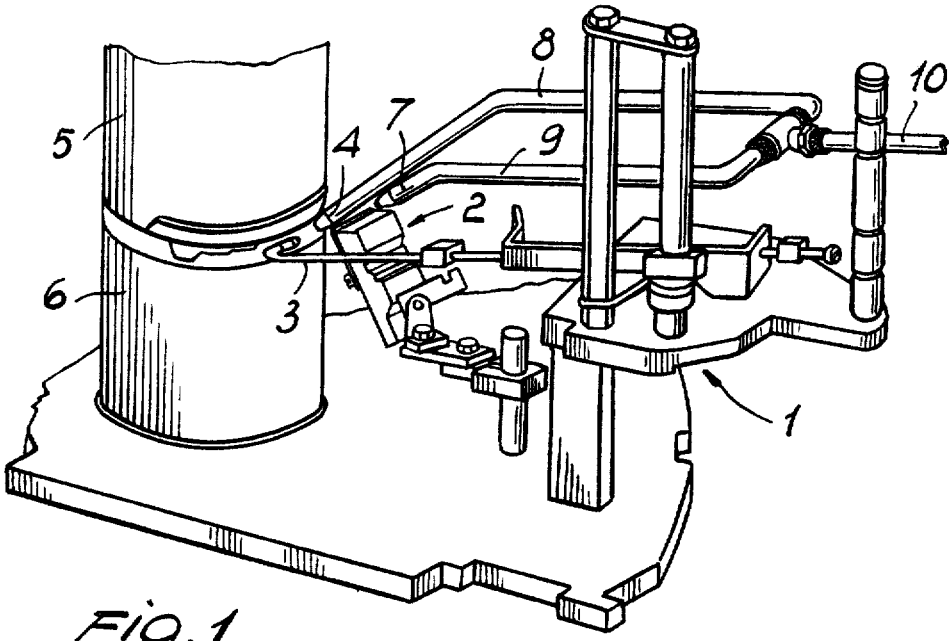
FIG. 1 is a simplified perspective view of a double cylinder circular knitting machine, evidencing the blowing nozzles arranged at one yarn feed.

FIG. 1 shows an exemplary double cylinder circular hose knitting machine including a striper unit 1 of the type disclosed in U.S. Pat. No. 3,605,444 and a yarn gripping and cutting device 2 of the type disclosed in U.S. Pat. No. 4,099,392. For clarity of illustration, the drawing shows but one feeding finger 3 of the striper unit 1. It will be understood that both the striper unit 1 and gripping/cutting device 2 may be different from the ones shown.

At the yarn feeding finger 3, there is arranged a blowing nozzle 4 adapted to blow, toward the needle cylinders 5 and 6, the yarn held by the feeding finger 3 upon the yarn being inserted to knit, such as to ensure that the yarn is picked up by the needles. In the proximity of the gripping and cutting device 2, there is instead arranged a blowing nozzle 7 adapted to assist in the releasing of the yarn from the gripping device 2, in order to prevent the yarn from the remaining caught in the gripping device and being again locked as the gripper is reclosed.

The nozzles 4 and 7 are connected to respective conduits 8,9 which extend from a single conduit 10 leading from a valve 11, whereto a supply conduit 12 is connected which is also connected to a source of compressed air, not shown. In normal conditions, the valve 11 holds the connection between the supply conduit 12 and dispensing conduit 10 closed.

The valve 11 is attached to an arm 13 journaled for free rotation on a fixed axle 14 and having a lug 15, whereto one end of a spring 16 is secured, the other end of the spring being secured to a stationary portion 17 of the machine.

Also journaled to the axle 14 for unimpeded rotation is an actuating lever 18, which is movable in a different plane from that including the arm 13 and valve 11, in which has a protruding end 19 constantly in contact, under the bias of the spring 16, with a bar 20 rigid with the lug 15 and perpendicular to the plane thereof. The opposite end 21 of the lever 18 is provided with a tooth-like element 22, adapted to follow the peripheral contour or profile of an actuating cam 23, the cam being provided with two diametrically opposed notches 24. The remaining portion of the cam profile is of circular pattern. The engagement of the element 22 with the profile of the cam 23 is ensured by a torque spring 25, which finds support at one end on the stationary portion 17 and at the other end on the end 19. In the inoperative condition, the element 22 is received into one of the notches 24.

Figure 2:
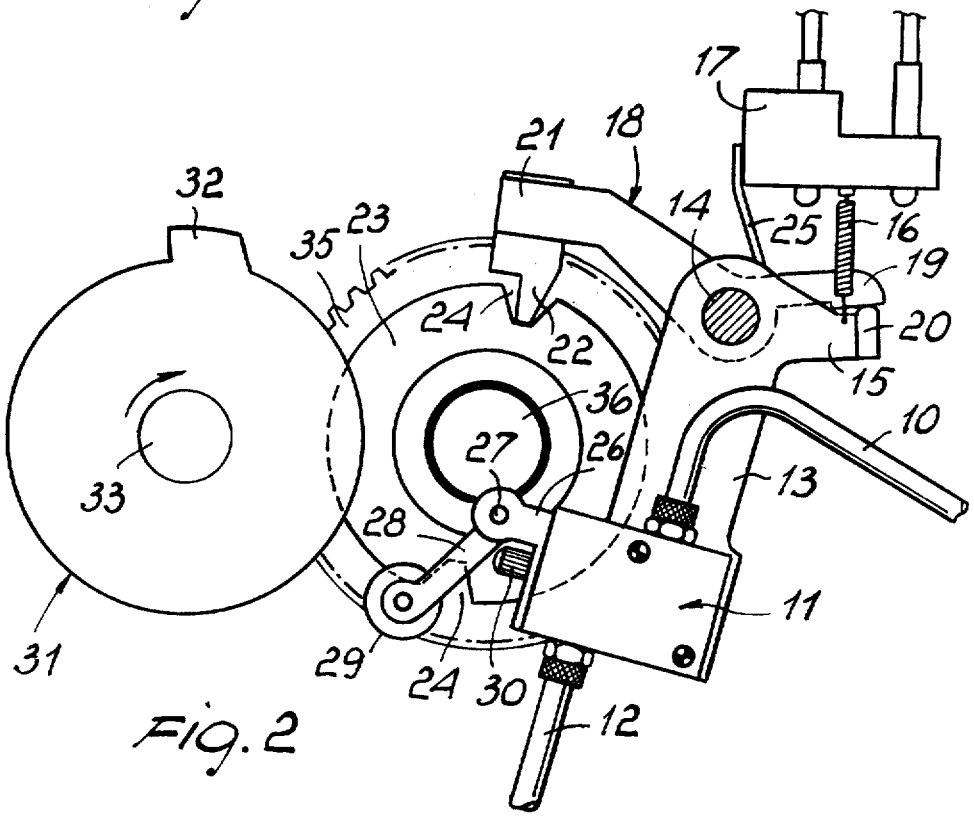
FIG. 2 is an elevational view of a device according to the invention in the inoperative or rest condition thereof, some parts of the machine being omitted for clarity.

To two lugs 26 projecting from the body of the valve 11, there are pivoted for unimpeded rotation at 27 two small parallel levers 28, which carry at their free ends an idle roller 29. The small levers 28, which are interconnected at their portions adjacent the pivot point 27, are adapted for acting on a pushbutton 30 of the valve 11 to control the opening of the valve such as to put the two conduits 10 and 12 in communication. In normal conditions, the levers 28 are spaced from the pushbutton 30, as shown in FIG. 2. The levers 28 and 29 constitute the actuating member proper of the valve 11.

Figure 3:
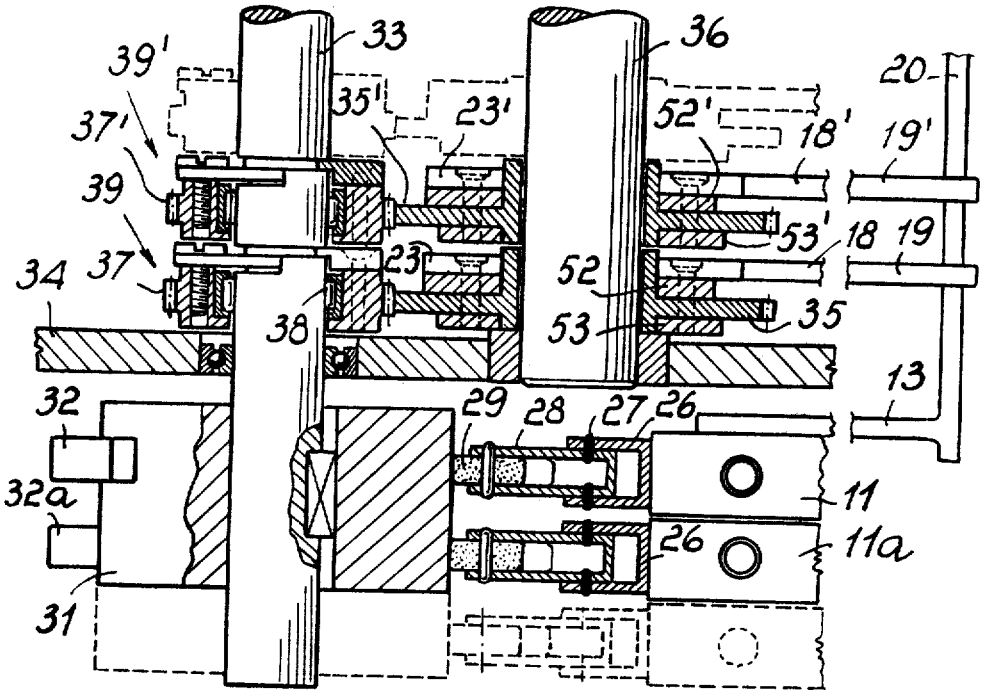
FIG. 3 is a bottom view, partly in section, of the device of FIG. 2.

The roller 29 is adapted to follow the profile of a control cam 31 provided with a substantially trapezoidal boss 32. The control cam 31 is rigid with a shaft 33 driven at a rotational speed which is synchronized with that of the needle cylinders 5 and 6, such as to complete one revolution for each revolution of the needle cylinders 5 and 6. The shaft 33 is supported, at one end thereof, by a side member 34 of the machine (FIG. 3). In normal conditions, the roller 29 is raised off the cam 31 by a distance exceeding the height of the boss 32, as shown in FIG. 2.

Figure 4:
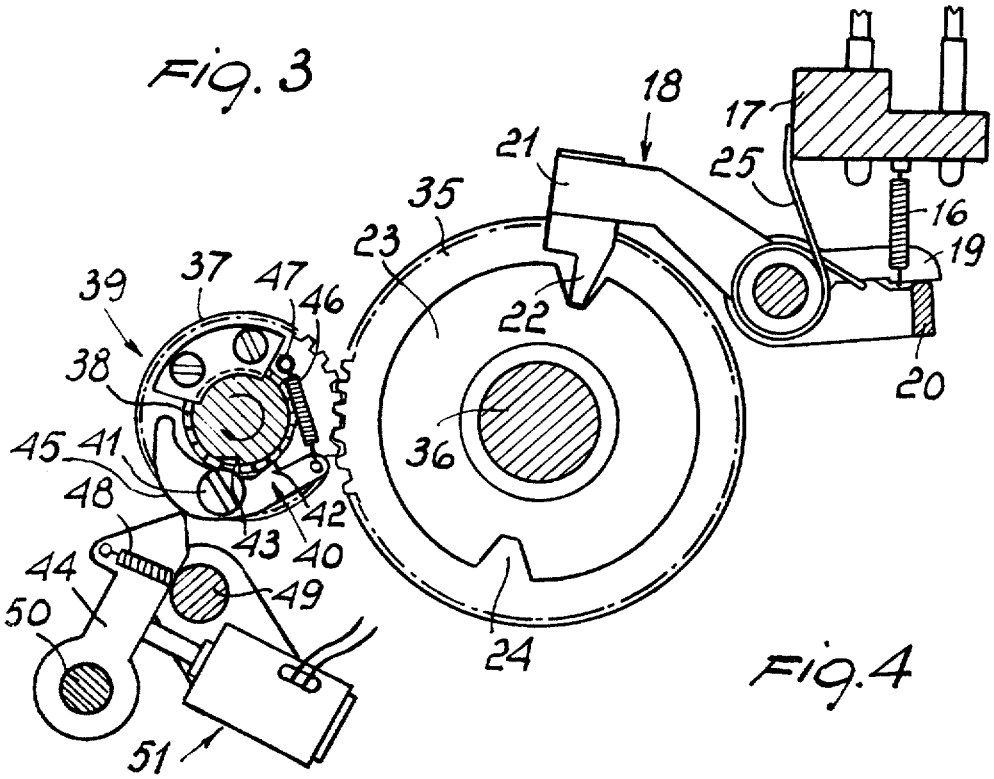
FIG. 4 is a detail view of the control unit for the device according to the invention.

The actuating cam 23 (FIG. 4) is rigid with a gear wheel 35 mounted idly on a shaft 36 which extends parallel to the shaft 33 and is supported, at one end, by the side member 34. The gear wheel 35 is in constant mesh with a gear wheel 37, in turn supported idly on the rotary shaft 33 through bearings 38. The gear ratio between the wheel 35 and wheel 37 is 2:1, thereby one revolution of the gear wheel 37 results in a half-revolution of the gear wheel 35.

The gear wheel 37 is part of a clutch or coupling 39 under control by the machine program. The gear wheel can be programmably locked to the shaft 33, and for this purpose, it is provided with a ratchet mechanism 40, which is journaled at an intermediate point 41 thereof to the gear wheel 37 along an axis parallel to the axis of the gear wheel. The ratchet 40 has a substantially arcuate configuration and is provided with an entrainment or driving tooth 42 on its inside corner edge which is adapted to enter an entrainment notch 43 formed in the shaft 33. In normal conditions, the tooth 42 will be raised from the notch 43, because the ratchet 40 is engaged by a small lever 44 along an arcuate outside corner edge 45 thereof. This engagement position is maintained by a spring 46, stretched between a fixed point 47 on the gear wheel 37 and that end of the ratchet 40 which is located, with respect to its pivot point 41, on the opposite side of the outer corner edge 45 engaged by the lever 44. The latter is held by a spring 48 against a fixed stop 49 and is journaled for free rotation about a fixed pivot pin 50.

The lever 44 is subjected to the action of a control which is programmed in accordance with the knitting operation to be carried out, as explained hereinafter. The control impulse may be derived from the machine main chain, e.g. as disclosed in U.S. Pat. No. 4,233,826. In the embodiment illustrated, however, it has been preferred to control the lever 44 through an electromagnet 51, in turn controlled by the main chain with the intermediary of a microswitch or the like, not shown. The energization of the electromagnet 51 results in the lever 44 being moved away from the stop 49 and in the ratchet 40 being released, under the action of the spring 46, thereby the tooth 42 snaps into the notch 43 as this moves in front of the tooth itself during the constant rotation of the shaft 33. The engagement of the tooth 42 into the notch 43 causes the gear wheel 37, and accordingly the gear wheel 35, to rotate, with the effects which will be described hereinafter.

So far, a basic yarn positioning device has been described which comprises a valve 11 and related members, a control cam 31, a clutch or coupling 39, an actuating lever 18, an actuating cam 23, etc. It should be noted, however, that for a given feed, a single valve 11 is actually provided with its related cam 31, and as many couplings 39 and respective actuating cams 23 and actuating levers 18, for independent operation, as are the yarn feeding fingers at that same feed. FIG. 3 shows accordingly two couplings 39,39' and associated members 35,35', 37,37', one assembly having the same reference numerals as before, whilst the other assembly has also the same numerals but primed (').

In dotted lines, moreover, there is shown a possible additional assembly formed by a coupling and related members. Each actuating lever 18,18'. . . contacts with its end 19,19'. . . the bar 20, which extends over the entire length of the shaft 36 occupied by cams 23,23'. . . and respective actuating levers 18,18'. . . .

With two feeds, there will be provided also two valves 11 and related control cams 31. FIG. 3 shows, in fact, a second valve **11*a*, side-by-side with the first, and related accessory parts. In this case, it is possible to have a single cam 31 with two bosses 32 and 32*a* which are offset and spaced apart in the axial direction of the cam. In FIG. 3, for clarity reasons, the bosses 32 and 32*a* are shown angularly offset with respect to the other drawing figures. In any case, the relative angular offsetting of the bosses 32 and 32*a* will correspond to the angular offsetting between the feeds around the needle cylinders 5,6. FIG. 3 shows in dotted lines how an additional valve 11** and related accesory parts may be provided for an additional feed.

FIG. 3 also illustrates cams 52,52' and 53, 53' which are rigid with the gear wheels 35,35' and cams 23,23', respectively. Such cams 52,52' and 53, 53' have been described in detail in the cited U.S. Pat. No. 4,233,826 and serve for controlling the yarn feeding fingers and gripping/cutting device, in the manner described in that same Patent. However, the yarn feeding finger control system could also be changed, on condition that the feeding fingers are controlled synchronically with the control of the device according to this invention, as discussed hereinafter.

The device of this invention operates as follows.

In normal conditions, when a yarn, as fed to the needles through the yarn feeding finger 3, is regularly knitted, the element 22 is accommodated in one of the notches 24 of the cam 23 and the arm 13 is at a rest or inoperative position such that the roller 29 is spaced from the cam 31 and is unaffected by the boss 32, while the cam 31 continues to rotate at the same rpm as the needle cylinders 5,6. The movably supported valve 11 of the respective feed is closed and no air jet is blown from the nozzles 4 and 7.

Figure 5:
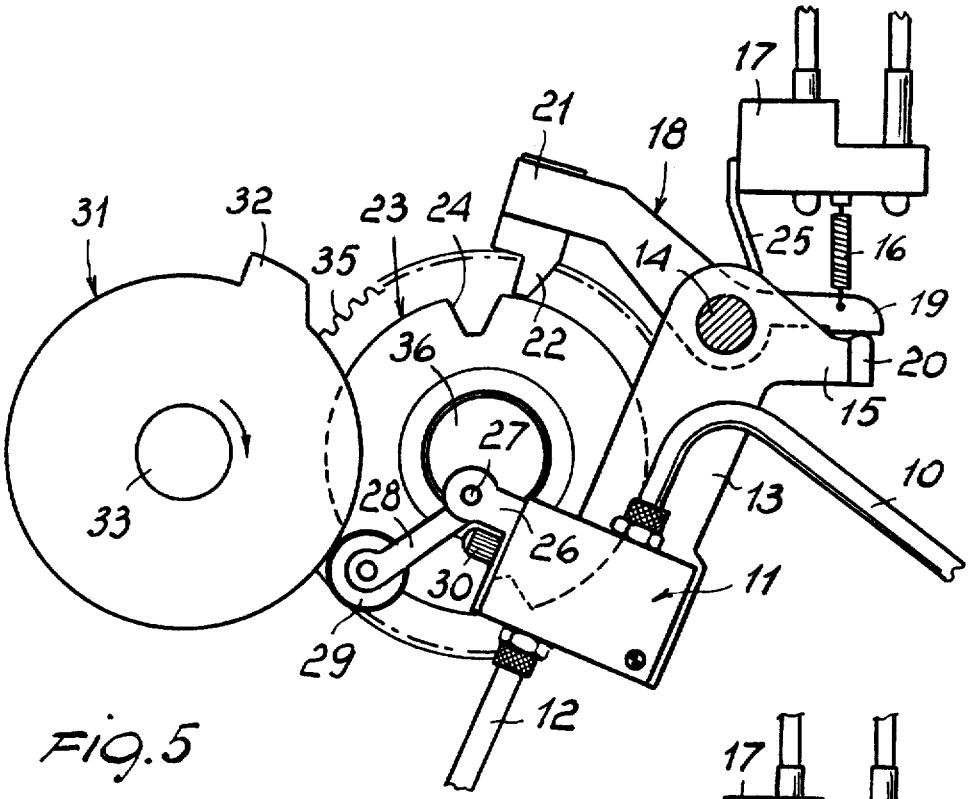
FIG. 5 illustrates the inventive device as at the start of its cutting in phase.

When one yarn must be replaced by another, there occurs a movement of the yarn feeding finger and gripping/cutting device, as described respectively in the cited U.S. Pat. Nos. 3,605,444 and 4,099,392. The control impulse which actuates the new yarn feeding finger also produces the synchronized operation of the blowing device according to the invention. In fact, the energization of the electromagnet 51 determines, as mentioned already, the engagement of the entraining tooth 42 with the entraining notch 43, and consequently the rotation of the gear wheels 37 and 35 (in the present instance, having assumed that the cams 52,52' and 53,53' control respectively the yarn feeding fingers and gripping/cutting device in the manner described in U.S. Pat. No. 4,233,826, that same control impulse will actuate the respective yarn feeding finger; however, it is also possible to simultaneously actuate the yarn feeding finger through a different member). The rotation of the gear wheel 35 determines the rotation of the actuating cam 23 to cause the element 22 to climb the circular portion of that same cam (FIG. 5). This produces a partial rotation of the actuating lever 18, and hence of the arm 13, to bring the latter closer to the cam 31, thereby the roller 29 contacts the surface of the cam 31. The valve 11, however, is still closed, but in a position for operation.

Figure 6:
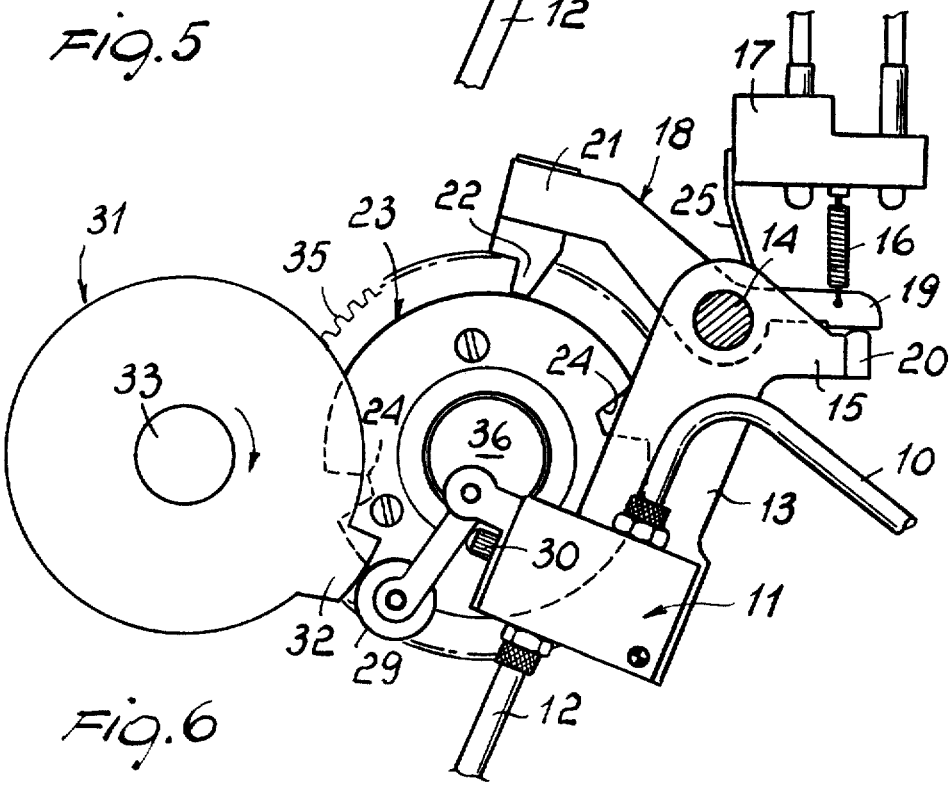
FIG. 6 shows the same device during the blowing phase, upon one yarn being inserted to knit.

As the rotation of the cam is continued, when the boss 32 moves past, the pushbutton 30 (FIG. 6) is actuated and the valve opens to put the conduits 10 and 12 in communication, such as to cause the emission of pressurized air from the nozzles 4 and 7. At this time, i.e. after the yarn feeding finger has already brought the yarn to the needles and the cutting device has already released the end of the yarn held therein since the completion of the preceding knitting step of that same yarn, the air jet from the two nozzles 4 and 7 will bring the released yarn toward the needles, thus ensuring that it is picked up by them, and ensuring that the end of the yarn has left the gripping device completely.

These operations required but a very short time to carry out, and the valve 11 will close upon the boss 32 moving further past it. In the meantime, the electromagnet 51 is de-energized by the machine main control, thereby the ratchet 40, after completing one revolution, is again engaged by the lever 44 and the coupling 39 released. The cam 23, which has completed a half-revolution, comes to a stop, while the element 22 drops back in the other of the notches 24, thus moving the arm 13 of the cam 31 away and locking instantaneously and firmly the whole assembly of elements associated therewith, until the next yarn change.

It should be noted that the phases just described occur identical for a given feed, regardless of the yarn feeding finger replaced, since with each yarn feeding finger there is associated a coupling 39 with its related actuating cam 23 and actuating lever 18, and because each associated actuating lever 18 acts on the same bar 20 which provides the shifting of the valve 11 into the operative position. Of course, the change or switching of one yarn at another feed will involve, in similar manner to that described, the actuation of the valve **11*a*, e.g. by providing for each other feed associated actuating levers 18' which act, rather than on the bar 20, on another bar whereto the valve 11*a* would be attached. However, it would also be possible to attach the two (or more) valves 11, 11*a* to the same bar 20 and cause all the actuating levers 18,18'**. . . of all the striper units to operatively act on said bar, but in this case there would occur the simultaneous application of air at two or more feeds, that is also at that (or those) feed(s) where no yarn switching takes place; however, this would cause no inconvenience, because the air jet alone is unable to withdraw a yarn from the gripping device, which remains closed where no yarn change or switch is to take place.

It will be appreciated that in a circular knitting machine already equipped with the yarn feeding finger control device utilizing couplings 39 and cams 52,53, etc., such as the machine described in the cited U.S. Pat. No. 4,233,826, the inclusion of a device according to this invention requires but a limited space, and yet ensures a blowing action which is synchronized with the movement of the yarn feeding fingers, independently of the number of yarn feeds.

From the foregoing description it is apparent, moreover, that a device according to the invention can be quite reliable in operation and controllable even when a different programmer from the conventional ones is used. In any case, a device according to this invention enables, for a modest constructional effort and within small overall dimensions, the blowing action control to be derived for each feed directly from the respective striper unit. The invention as described is susceptible to many modifications and variations, within the scope of the instant inventive concept. Thus, for example, it is not strictly necessary that the cam 31 be continuously rotating, but it could be driven to rotate synchronically with the coupling 39 each time that a yarn must be changed or switched. It would also be possible to associate with each nozzle 4 and 7 a respective valve 11 with a control unit of its own. It will be appreciated that this device can also be applied to single cylinder circular knitting machines.

I claim:

1. A device for correctly positioning yarns prior to knitting in a circular knitting machine, in particular a hose knitting machine, of the type comprising at least one needle cylinder, at least one striper unit having a plurality of yarn feeding fingers, a yarn cutting and gripping device and means for actuating said yarn feeding fingers and yarn cutting and gripping device according to a machine knitting program, the device comprising blowing nozzles respectively oriented towards said at least one needle cylinder and said yarn cutting and gripping device, at least one movably supported valve for admitting pressure fluid from a pressure fluid supply conduit to said nozzles, and control means for controlling said at least one valve, wherein said control means comprise at least one continuously rotatable control cam and means associated with said at least one valve for moving said at least one valve between a rest position and a position for operation in which said at least one control cam operates thereon to cause said at least one valve to provide communication between said supply conduit and said nozzles simultaneously with the actuation of any one of said yarn feeding fingers of said at least one striper unit.

2. A device as claimed in claim 1, comprising actuating cams each associated to one of said yarn feeding fingers of said at least one striper unit, respectively couplings between each of said actuating cams and said at least one control cam, and means for rotating said at least one control cam synchronically with said at least one needle cylinder, said couplings being each selectively controlled by said machine program simultaneously with a respective one of said yarn feeding fingers, whereby rotation of a corresponding one of said actuating cams provides positive control of said at least one valve by said at least one control cam when a corresponding one of said couplings causes said at least one control cam and corresponding one of said actuating cams to become mechanically interconnected for rotation.

3. A device as claimed in claim 2, further comprising an arm supporting said at least one valve, said arm being movable towards and away from said at least one control cam upon actuation of any one of said couplings and corresponding rotation of a respective one of said actuating cams.

4. A device as claimed in claim 3, further comprising respective actuating levers between each of said actuating cams and said arm, each of said actuating levers being operatively connected to said arm for controlling movement thereof.

5. A device as claimed in claim 3, further comprising respective actuating levers between each of said actuating cams and said arm, each of said actuating levers being operatively connected to said arm for controlling movement thereof, each of said actuating cams having two diametrically opposed notches and each of said actuating levers having a nose element for engaging a corresponding one of said notches and locking a respective one of said actuating levers and said arm in an inoperative position wherein said at least one valve is closed.

6. A device as claimed in claim 2, wherein said at least one control cam has at least one boss thereon and said at least one valve has an actuating member pivoted thereon for effecting opening of said at least one valve when said actuating member engages said at least one boss.

7. A device as claimed in claim 2, wherein said couplings are each operatively connected to an actuating member of a respective one of said yarn feeding fingers.

8. A device as claimed in claim 7, wherein said couplings are each operated electromagnetically.

9. A device as claimed in claim 1, comprising a plurality of said valves arranged in side-by-side relationship, said valves being provided in a number corresponding to the number of said striper units.

10. A device as claimd in claim 1, comprising two of said blowing nozzles for said at least one valve, one of said two blowing nozzles being oriented towards said at least one needle cylinder for blowing yarn towards said at least one needle cylinder and another of said two blowing nozzles being oriented towards said yarn cutting and gripping device for releasing yarn from said yarn cutting and gripping device.

11. A device as claimed in claim 1, comprising a plurality of said valves arranged in side-by-side relationship, said valves being provided in a number corresponding to the number of said striper units, said at least one control cam having a plurality of bosses thereon corresponding to the number of said valves and each of said valves having an actuating member for engaging a corresponding one of said bosses, said bosses being arranged axially spaced from one another on said at least one control cam and being circumferentially spaced from one another by an extent corresponding to circumferential spacing between said striper units around said at least one needle cylinder.

* * * * *